United States Patent [19]

Slasinski

[11] Patent Number: 4,660,403

[45] Date of Patent: Apr. 28, 1987

[54] DIE ASSEMBLY

[75] Inventor: Arthur L. Slasinski, Harper Woods, Mich.

[73] Assignee: Weldex, Inc., Warren, Mich.

[21] Appl. No.: 811,136

[22] Filed: Dec. 19, 1985

[51] Int. Cl.[4] ..... B21D 5/01

[52] U.S. Cl. ..... 72/389; 72/396; 29/432; 29/509

[58] Field of Search ..... 72/381, 383, 386, 389, 72/399, 400, 401, 396; 29/509, 243.53, 243.52, 432, 522 A, 522, 21.1; 227/18

[56] References Cited

U.S. PATENT DOCUMENTS

| | | | |
|---|---|---|---|
| 2,362,006 | 11/1944 | Herzog | 72/396 |
| 2,619,855 | 12/1952 | Williams | 29/432 |
| 2,671,361 | 3/1954 | Sandberg | 29/432 |
| 3,258,948 | 7/1966 | Carlson | 72/396 |
| 3,579,809 | 5/1971 | Wolf | 29/509 |
| 4,459,735 | 7/1984 | Sawdon | 29/509 |

FOREIGN PATENT DOCUMENTS

| | | | |
|---|---|---|---|
| 661471 | 6/1938 | Fed. Rep. of Germany | 72/400 |

*Primary Examiner*—R. L. Spruill
*Assistant Examiner*—David B. Jones
*Attorney, Agent, or Firm*—Cullen, Sloman, Cantor, Grauer, Scott & Rutherford

[57] ABSTRACT

An improved die assembly for use with a punch is employed to produce stitch connections between sheets of rigid, deformable material. The die assembly includes an anvil body having a central anvil portion and a pair of arcuate depressions respectively on opposite sides of the central anvil. A pair of die portions are pivotally mounted on opposite sides of the anvil and include curved sections which are conjugally received within the depressions of the anvil body and function to transmit force applied by the punch through the curved sections to the anvil body, thereby relieving the pivotal connections from undue stress. The die portions and the anvil body are provided with opposing surfaces between which there are trapped coil springs for urging the die portions toward each other. In an alternate embodiment, biasing of the die portions toward each other is achieved by surrounding the die portions with a layer of molded, resilient material such as urethane. In another embodiment, the pins which pivotally mount the die portions are supported on lateral shoulders of the anvil body so that the punch force is transmitted through the pins to the anvil body.

12 Claims, 10 Drawing Figures

Fig-1
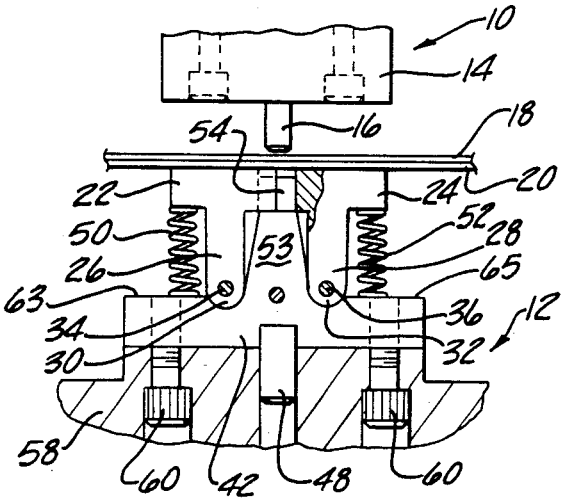
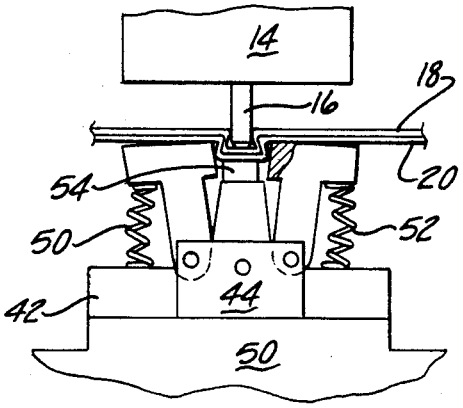
Fig-2
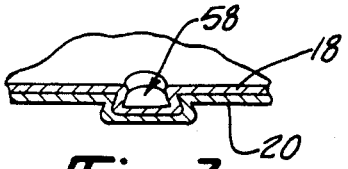
Fig-3
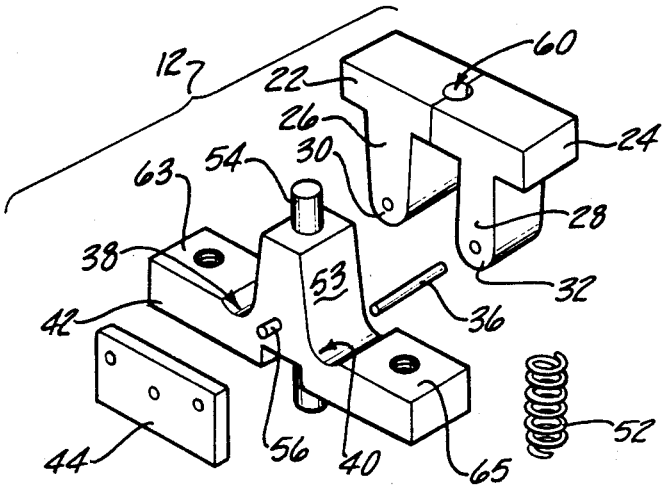
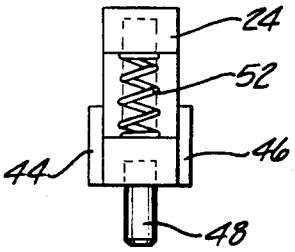
Fig-4
Fig-5

DIE ASSEMBLY

TECHNICAL FIELD

The present invention broadly relates to punch and die assemblies, and deals more particularly with an improved die assembly of a type for producing a stitched interconnection between two sheets of rigid, deformable material.

BACKGROUND ART

Various types of punch and die assemblies have been devised in the past in order to join two sheets of material, such as metal, by means of a localized, interlocking deformation, sometimes referred to as a stitch. Stitches may be of a lanced type in which either one or both sheets of the metal are pierced, or may be of a so-called "leak-proof" type as disclosed in U.S. Pat. No. 4,459,735 issued on July 17, 1984 to Sawdon.

Punch and die assemblies used to form stitch joints of the type described above typically include an anvil body and a pair of die portions which are pivotally mounted on the anvil body. One or more springs are employed to bias the die portions toward each other. The die portions are forced away from each other upon engagement therewith by the punch which forces portions of the sheet metal between the die portions and into engagement with an anvil. The relatively high impact forces applied to the die assembly by the punch and the normally high repetition rate of production operations imposes extraordinary forces on the component parts of the die assembly. Particularly susceptible to failure are the springs which bias the die portions together and the pins which pivotally mount the die portions on the anvil body. Failure of the above-mentioned components in a production environment results in down-time in order to exchange dies and is also costly from the standpoint of repairing the dies.

SUMMARY OF THE INVENTION

According to the present invention, an improved die assembly is provided which is exceptionally rugged in design and is therefore less prone to component failure. An anvil body has a central anvil portion and a pair of arcuate depressions respectively on opposite sides of the anvil portion. A pairof die portions are provided with curved sections respectively conjugally received within the depressions of the anvil body. The curved sections of the die portions transmit force to the arcuate depressions of the anvil body upon impact of the punch. The die portions are pivotally mounted on the anvil body by a pair of pins. Stress on the pins due to impact of the punch on the die portions is substantially relieved by virtue of the fact that such force is transmitted from the die portions to the anvil body through the mating, conjugal surfaces of the die portions and anvil body. The guide portions and anvil body are provided with opposing, substantially parallel surfaces, between which there is trapped a pair of springs which function to urge the die portions to pivot toward each other into a closed position in preparation for impact of the punch. In another embodiment of the invention, the pivot pins on which the die portions are mounted engage the anvil body so that force applied by the punch to the die portions is transmitted through the pivot pins to the anvil body. In another alternate form of the die assembly, the die portions are biased to pivot toward each other by means of a layer of resilient, flexible material such as urethane which surrounds and conformally envelops the die portions. The die assembly is well adapted for forming various types of stitch connections, including those of the lanced type as well as unlanced, leak-proof connections.

Accordingly, it is a primary object of the present invention to provide a die assembly of the type for producing stitch connections between two sheets of rigid material, which is particularly rugged in design and not subject to component failure upon repeated use.

Another object of the invention is to provide a die assembly, as described above, in which the stress on pivot pins which swingably mount the die portions on an anvil is relieved of stress imposed by engagement therewith of a punch.

A still further object of the invention is to provide a die assembly as mentioned above in which the force applied to the die portions by the punch is largely transmitted directly to the anvil body by direct mechanical engagement between the die portions and anvil body.

Another object of the invention is to provide a die assembly as described above in which the die portions are biased toward each other and into a closed position by means of a pair of independently mounted springs.

A still further object of the invention is to provide a die assembly as described above in which the die portions are biased toward each other into a closed position without the use of coil springs or the like. As a corollary to the foregoing object, a still further object to the invention is to provide a die assembly in which several of the component parts thereof are surrounded with a layer of resilient, flexible material which functions to maintain the component parts in a predefined relationship with each other.

These, and further objects of the invention will be made clear or will become apparent during the course of the following description of a preferred embodiment of the present invention.

BRIEF DESCRIPTION OF THE DRAWINGS

In the drawings, which form an integral part of the specification and are to be read in conjunction therewith, and in which like components are designated by identical reference numerals in the various views:

FIG. 1 is a side elevational view, partially in section, of an improved die assembly which forms one embodiment of the present invention, shown in relationship to a punch immediately prior to forming a stitch between two sheets of material, a mounting plate having been removed for clarity;

FIG. 2 is a view similar to FIG. 1 but showing the stitch being formed by the punch, with the die portions pivoted to their fully open position;

FIG. 3 is a cross-sectioned, perspective view of a leak-proof joint formed by the operation shown in FIGS. 1 and 2;

FIG. 4 is an end view of the die assembly shown in FIGS. 1 and 2;

FIG. 5 is an exploded, perspective view of the die assembly shown in FIGS. 1, 2 and 4;

DESCRIPTION OF THE PREFERRED EMBODIMENTS

Figure 6:
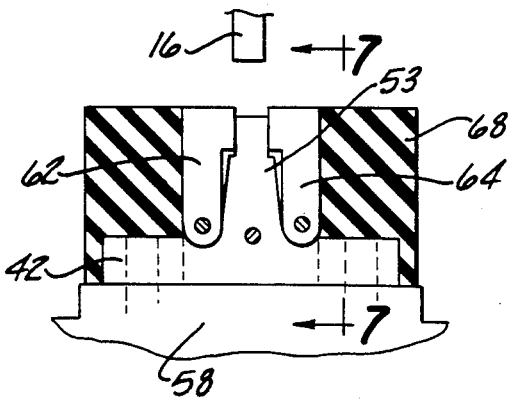
FIG. 6 is a side view of an alternate form of the improved die assembly, the layer of resilient biasing material having been broken away in section.

Referring first to FIGS. 1–4, the present invention broadly involves a die assembly generally indicated by the numeral 12 which is adapted to be employed with a punch assembly 10 for forming a locking interconnection or stitch 58 between two sheets of rigid, deformable material 18, 20 such as metal. As shown in FIG. 3, the interlocking stitch 58 formed between the sheets of metal 18, 20 is of a leak-proof type in which neither of the sheets are fully pierced. However, it is to be understood that the improved die assembly of the present invention may be configured to produce any of numerous other types of stitches, as will become apparent hereinafter.

The punch assembly 10 includes a body 14, typically secured to a press (not shown) or other device for moving the body 14 toward and away from the die assembly 12. The punch element 16, herein shown as cylindrical in shape, is mounted on the punch body 14 and extends downwardly for contacting the upper sheet 18 of material to be stitched.

The die assembly 12 broadly comprises an anvil body 42 and a pair of die portions 26, 28 which are pivotally mounted on the anvil body 42 by a pair of corresponding pivot pins 34, 36. The anvil body 42 includes a central, upstanding anvil base 53 which terminates in an anvil head 54 extending above the anvil base 53. The anvil head 54 coacts with the punch element 16 and is adapted to be engaged by the lower sheet 20 during the stitch forming process.

The anvil body 42 is mounted on a base 58 by means of screws 60. The longitudinal position of the anvil body 42 on the base 58 is determined by a locating pin 48. It should be noted here that although it was previously mentioned that the punch assembly 10 is reciprocally mounted, such punch assembly 10 could be stationarily mounted with the relative movement between the punch and die being accomplished by reciprocally mounting the base 58 so as to move toward and away from the punch element 16.

The anvil body 42 is provided with a pair of laterally extending shoulders 63 and 65 which define surfaces that extend essentially parallel to the sheets 18 and 20 of the material. Between the central anvil base 53 and the shoulders 63, 65, there are provided a pair of arcuately shaped depressions 38, 40. Within the depressions 38, 40, there are closely received, in conjugal relationship, the curved surface portions of the lower extremities 30, 32 of the die portions 26, 28 respectively. The die portions 26, 28 include corresponding lateral extensions 22, 24 which form surface portions that extend parallel to and oppose the shoulders 63, 65 of the anvil body 42. Within these latter-mentioned opposing surfaces, there are trapped a pair of corresponding coil springs 50, 52 which function to bias the die portions 26, 28 to pivot toward each other about the pivot pins 32, 34. The component parts of the die assembly 12 are held in registered relationship with each other by means of a pair of retainer plates 44, 46 which are pierced by the pivot pins 34, 36 as well as a retaining pin 56.

The die portions 26, 28 are provided with cutouts in the opposing engaging faces thereof that define a cylindrical opening 60 (FIG. 5) within which the punch element 16 is received. The particular configuration of these cutouts will vary in accordance with the type and geometry of the stitch which is to be produced.

In operation, the sheets 18, 20 are placed on the upper flat surfaces of the die portions 26, 28, overlying the die opening 60. The punch assembly 10 and the die assembly 12 are then moved toward each other such that the punch element 16 engages the upper sheet 18 and forces a portion of the material of the sheets 18, 20 toward the anvil head 54. The deforming sheet material is forced downwardly between the die portions 26, 28 and forces the latter to pivot outwardly away from each other, as best seen in FIG. 2. The outward pivotal movement of the die portions 26, 28 is partially resisted by the coil springs 50 and 52. By virtue of the independent mounting of springs 50 and 52, the biasing force imposed on the die portions 26, 28 is independent and is therefore proportional to the force exerted by the deforming sheets. As the punch element 16 engages the sheets 18, 20, a downwardly acting force component is imposed upon the die portions 26, 28 by such sheets. This downward force component is transferred through the lower extremities 30, 32 directly to the anvil body 42, thereby relieving a substantial amount of stress on the pivot pins 34, 36.

Figure 7:
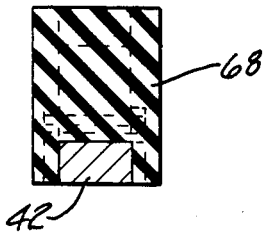
FIG. 7 is a sectional view taken along the line 7—7 in FIG. 6.
Figure 8:
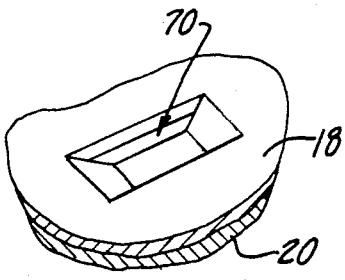
FIG. 8 is a perspective view of the stitch produced by the die assembly shown in FIGS. 6 and 7.

Reference is now made to FIGS. 6–8 wherein an alternate embodiment of the improved die assembly is depicted along with a stitched interconnection produced thereby. The alternate form of the improved die assembly includes an anvil body 42 identical to that previously described and a pair of die portions 62, 64 similar to those previously described. The configuration of the upper surfaces as well as the opposing faces of the die portions 62, 64 are such as to result in a generally rectangular stitch 70 (FIG. 8) which is of the pierced type in which both the sheets 18, 20 are actually pierced. The die assembly shown in FIGS. 6 and 7 is otherwise generally identical to that previously described with the exception of the means which are provided to bias the die portions 62 and 64 to pivot toward each other to a closed position. Such biasing means are defined by a layer 68 of flexible, resilient material such as urethane which is molded around the anvil body 42 and die portions 62, 64. As best seen in FIG. 6, the layer 68 of resilient material conformally engages the sides of the die portions 62 and 64 and therefore biases the latter to pivot toward each other to their normally closed position. The layer 68 of material is sufficiently compressible to allow the die portions 62, 64 to pivot outwardly when the punch element 16 forces sheet material down toward the anvil base 53. The resiliency of the layer 68 of material then forces the die portions 62, 64 to return to their closed position when the stitched material is removed from the die assembly. The layer 68 of material continuously surrounds the die portions 62, 64 and may be installed by molding a conformal material around the die portions 62,64 and anvil base 42. It has been found that the layer 68 of material provides a trouble-free means of biasing the die portions 62, 64 toward each other since it is not subject to breakage as in the case of coil springs. Moreover, the layer 68 of material provides a consistent degree of biasing influence which improves the consistency of the stitch produced by the die assembly.

Figure 9:
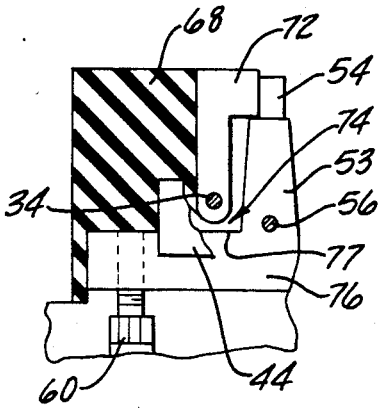
FIG. 9 is a fragmentary view, taken partially in section, of another alternate form of the improved die assembly.

Attention is now directed to FIG. 9 wherein another alternate form of the improved die assembly of the present invention is depicted. The die assembly shown in FIG. 9 is similar to that shown in FIG. 6 with the following exceptions. The anvil body 76 has shoulders 77 which are essentially flat, in comparison with the shoulders 63, 65 of the previously described anvil body 42, which possess depressions 38, 40 on opposite sides of the anvil base 53. Identical die portions 72 (only being shown in FIG. 9) are pivotally mounted by means of pivot pins 34 at locations such that the bottom of the die portions 72 are spaced above the anvil shoulders 77 so as to create a clearance 74 therebetween. Because of the clearance 74, the force imposed by the punch 16 on the die portions 72 is transmitted to and is absorbed by the pivot pins 34. The layer of flexible, resilient material 68 surrounds the die portions 72, as discussed with reference to the embodiment shown in FIG. 6.

Figure 10:
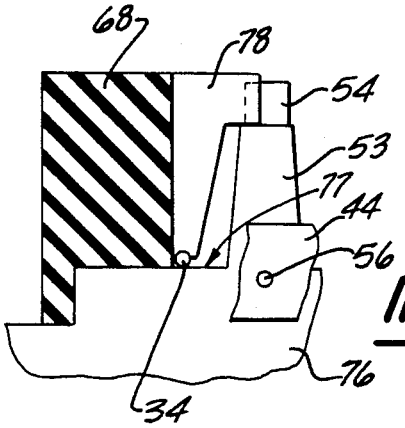
FIG. 10 is a fragmentary view, partially in section, of another alternate form of the improved die assembly.

Still another form of the improved die assembly is shown in FIG. 10, which is identical to that described with reference to FIG. 9, with the following exceptions. Die portions 78 are pivotally mounted on the anvil base 76 by means of pivot pins 34 which engage the flat shoulder surfaces 77. The lower ends of the die portions 78 are provided with arcuate depressions therein which conjugally receive the upper rounded surface of the pivot pins 34. Force imposed by the punch 16 on the die portions 78 is transmitted to the anvil base 76 directly through the pivot pin 34. In the embodiments shown in FIGS. 1 and 6, in order to transmit the force imposed by the punch 16 to the anvil base 42, it is necessary to provide a tight tolerance between the curved bottoms of the die portions 62,64 and the depressions 38, 40 in the anvil base 42. However, in the embodiment shown in FIG. 10, the force imposed by the punch 16 is not transmitted by contact between the die portions and the anvil base, but rather is transmitted by virtue of direct contact between the pivot pin 34 and the anvil base 76.

From the foregoing, it is apparent that the improved die assembly described above not only provides for the reliable accomplishment of the objects of the invention but does so in a particularly effective and economical manner. It is recognized, of course, that those skilled in art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. A die assembly for use with a reciprocal punch for forming a stitch between two sheets of deformable material, said die assembly comprising:

an anvil body having a central anvil and a pair of arcuate depressions respectively on opposite sides of said central anvil; and a pair of die portions having curved sections respectively and matingly received within said depressions, said die portions being pivotable between first and second positions upon reciprocal operation of said punch with said curved sections continually engaging said depressions between said first and second positions and transmitting force through said curved sections to said anvil body upon impact with said die portions by said punch; and means for pivotally mounting said die portions on said anvil body for movement toward and away from each other.

2. The die assembly of claim 1, including a pair of springs respectively disposed between said die portions and said anvil body, said springs urging said die portions to pivot toward each other.

3. The die assembly of claim 2, wherein said springs are elongate and the longitudinal axes of said springs extend essentially parallel to the path of travel of said punch.

4. The die assembly of claim 3, wherein said die portions and said anvil body respectively include opposing surface portions and said springs are trapped between said opposing surface portions.

5. The die assembly of claim 1, including means substantially surrounding said die portions for biasing said die portions to pivot toward each other.

6. The die assembly of claim 5, wherein said biasing means conformally engages one side of each of said die portions.

7. The die assembly of claim 5, wherein said biasing means is defined by a urethane material.

8. A die assembly adapted for use with a punch for forming a stitch between two sheets of rigid deformable material, comprising:

an anvil aligned with said punch and adapted to be engaged by said sheet material during forming of the stitch, said anvil having a pair of laterally extending shoulders with arcuate depressions therein;

a pair of die portions pivotally mounted on said anvil, said die portions including surface areas respectively opposing said shoulders and curved surfaces matingly received within said depressions, said die portions being pivotable between first and second positions upon reciprocal operation of said punch with said curved sections continually engaging said depressions between said first and second positions; and a pair of springs for biasing said die portions to pivot toward each other, said springs being respectively trapped between the surface portions of said die portions and the shoulders of said anvil;

whereby the force imposed on said die portions by said punch is transmitted to said anvil through the curved surface portions of said die portions.

9. The die assembly of claim 8, wherein said anvil includes a central anvil portion and said depressions in said shoulders are respectively disposed between said central anvil portion and said shoulders.

10. A die assembly for use with a punch for forming a stitch between two sheets of deformable material, said die assembly comprising:

an anvil body having a central anvil and a pair of shoulders respectively on opposite sides of said central anvil;

a pair of die portions mounted adjacent said anvil, said die portions cooperating with said punch and said central anvil to form said stitch;

a pair of pivot supports on respective sides of said central anvil, each of said pivot supports having one side thereof engaging the corresponding anvil shoulder, the opposite side of each of said pivot supports having a curved surface for pivotally supporting a corresponding one of said pair of die portions whereby force imposed on said die portions by said punch is transmitted through said pivot supports to said anvil shoulders.

11. The die assembly of claim 10, wherein said pivot supports each include a pivot pin and said die portions include arcuate depressions therein which conjugally engage and are supported on one side of said pivot pins.

12. The die assembly of claim 11, wherein said shoulders include essentially flat surface portions, and the other side of said pivot pins engage said flat surface portions.

* * * * *